US010244830B2

(12) United States Patent
Schooley et al.

(10) Patent No.: US 10,244,830 B2
(45) Date of Patent: Apr. 2, 2019

(54) CLASP MECHANISMS FOR WRISTWATCH BANDS

(71) Applicant: Google LLC, Mountain View, CA (US)

(72) Inventors: Stephen Theodore Schooley, Menlo Park, CA (US); Frank Jay Ziberna, Winfield, IL (US); Roger Hsu, Mountain View, CA (US); Keeline Burdick Wilcox, San Francisco, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 15/609,508

(22) Filed: May 31, 2017

(65) Prior Publication Data

US 2017/0258186 A1 Sep. 14, 2017

Related U.S. Application Data

(63) Continuation of application No. 15/296,540, filed on Oct. 18, 2016, now Pat. No. 9,839,264, which is a (Continued)

(51) Int. Cl.

| | |
|---|---|
| ***A44C 5/14*** | (2006.01) |
| ***A44C 5/20*** | (2006.01) |
| ***G04B 37/14*** | (2006.01) |

(52) U.S. Cl.

CPC ..... *A44C 5/145* (2013.01); *A44C 5/2057* (2013.01); *G04B 37/1486* (2013.01)

(58) Field of Classification Search

CPC .... A44C 5/145; A44C 5/2057; G04B 37/1486
See application file for complete search history.

(56) References Cited

U.S. PATENT DOCUMENTS

| | | | |
|---|---|---|---|
| 1,493,449 | A | 5/1924 | Axel Person |
| 1,508,612 | A | 9/1924 | Potter |

(Continued)

FOREIGN PATENT DOCUMENTS

| | | |
|---|---|---|
| CH | 704810 | 10/2012 |
| CN | 1628568 A | 6/2005 |

(Continued)

OTHER PUBLICATIONS

Aspen Express, "Quick Release Stainless Steel Double Shoulder 20mm Wide Pins for Watch Strap," Amazon, May 20, 2015, retrieved from <http://www.amazon.com/Quick-Release-Stainless-Double-Shoulder/dp/B00507NVLS> on Sep. 14, 2015, 5 pages.

(Continued)

*Primary Examiner* — Abigail E Troy
*Assistant Examiner* — David M Upchurch
(74) *Attorney, Agent, or Firm* — Fish & Richardson P.C.

(57) ABSTRACT

A watch band includes a strap and a clasp mechanism integrated with an end of the strap. The clasp mechanism includes a concave member defining a channel at the end of the strap and a cover plate. The cover plate is configured to move between (i) a first position in which the cover plate covers the channel, and (ii) a second position in which the cover plate is retracted to leave at least part of the channel uncovered by the cover plate.

14 Claims, 16 Drawing Sheets

Related U.S. Application Data continuation of application No. 14/854,347, filed on Sep. 15, 2015, now Pat. No. 9,498,029.

(60) Provisional application No. 62/133,073, filed on Mar. 13, 2015.

(56) References Cited

U.S. PATENT DOCUMENTS

| | | | | | |
|---|---|---|---|---|---|
| 1,538,819 | A * | 5/1925 | Kay | A44C 5/145 | 24/376 |
| 1,654,344 | A | 12/1927 | Myrberg | | |
| 1,715,153 | A * | 5/1929 | Wallenthin | A44C 5/145 | 224/177 |
| 2,827,213 | A | 3/1958 | Cornu | | |
| 2,850,783 | A | 9/1958 | Megar | | |
| 2,876,521 | A * | 3/1959 | Legman | A44C 5/145 | 24/265 WS |
| 3,042,277 | A * | 7/1962 | Stradella | A44C 5/2071 | 224/176 |
| 3,165,884 | A | 1/1965 | Gwinner | | |
| 3,685,107 | A * | 8/1972 | Epiard | A44C 5/14 | 24/601.7 |
| 3,818,552 | A | 6/1974 | Droz | | |
| 3,929,265 | A | 12/1975 | Pyne et al. | | |
| 4,398,324 | A * | 8/1983 | Bakker | A44B 11/263 | 24/615 |
| 4,414,714 | A | 11/1983 | Kostanecki | | |
| 4,541,151 | A | 9/1985 | Herchenbach | | |
| 4,546,522 | A * | 10/1985 | Gygax | A44C 5/24 | 16/267 |
| 4,793,030 | A | 6/1988 | Hirsch | | |
| 5,102,023 | A | 4/1992 | Nguyen | | |
| 5,158,219 | A | 10/1992 | Baumgartner et al. | | |
| 5,323,516 | A | 6/1994 | Hartmann | | |
| 5,483,505 | A * | 1/1996 | Cartier | G04B 37/1493 | 224/164 |
| 5,914,913 | A | 6/1999 | Shriqui | | |
| 6,014,793 | A | 1/2000 | Howald | | |
| 6,272,836 | B1 | 8/2001 | Fat | | |
| 6,328,188 | B1 * | 12/2001 | Boznos | A44C 5/107 | 224/164 |
| 6,446,466 | B1 * | 9/2002 | Headley | A44C 5/2071 | 24/605 |
| 7,496,994 | B1 | 3/2009 | Headley | | |
| 7,695,187 | B2 | 4/2010 | So et al. | | |
| 8,662,743 | B2 * | 3/2014 | Speichinger | G04B 37/1486 | 224/165 |
| 9,161,582 | B2 | 10/2015 | Anderson | | |
| 2002/0089193 | A1 | 7/2002 | Terasawa et al. | | |
| 2007/0070823 | A1 | 3/2007 | Sima | | |
| 2007/0097688 | A1 | 5/2007 | Gibbons | | |
| 2011/0113599 | A1 * | 5/2011 | Ehrsam | A44C 5/14 | 24/573.11 |
| 2012/0087216 | A1 | 4/2012 | Keung et al. | | |
| 2013/0088943 | A1 | 4/2013 | Teixeira | | |
| 2016/0037874 | A1 * | 2/2016 | Webb | A44C 5/24 | 224/267 |

FOREIGN PATENT DOCUMENTS

| | | |
|---|---|---|
| CN | 100577051 C | 1/2010 |
| EP | 0471834 | 7/1994 |
| JP | 2002-253311 | 9/2002 |
| WO | 2015005969 | 1/2015 |
| WO | 2015/199610 | 12/2015 |

OTHER PUBLICATIONS

International Search Report and Written Opinion in International Application No. PCT/US2016/016970, dated Apr. 29, 2016, 14 pages.

Office Action issued in Korean Application No. 10-2017-7026884, dated Mar. 13, 2018, 23 pages (with English Translation).

Office Action issued in Chinese Application No. 201710729284.1, dated Oct. 12, 2018, 16 pages (with English translation).

* cited by examiner

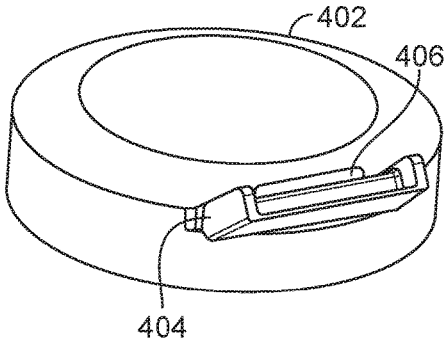
FIG. 4E-A
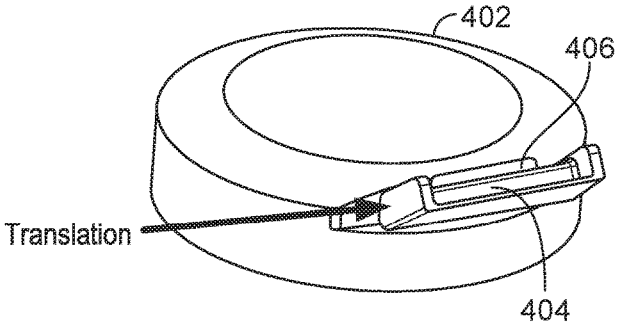
FIG. 4E-B
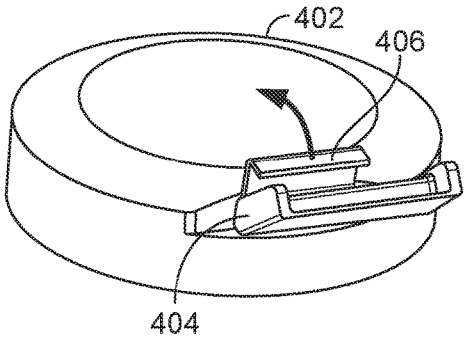
FIG. 4E-C
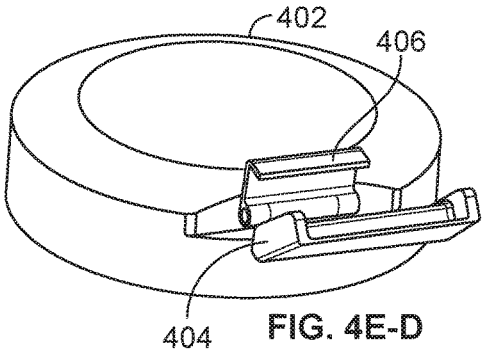
FIG. 4E-D

CLASP MECHANISMS FOR WRISTWATCH BANDS

CROSS-REFERENCE TO RELATED APPLICATIONS

This patent application is a continuation of and claims benefit of U.S. application Ser. No. 15/296,540, filed Oct. 18, 2016, which is a continuation of and claims the benefit of U.S. application Ser. No. 14/854,347 (now U.S. Pat. No. 9,498,029), filed on Sep. 15, 2015, which claims the benefit of the filing date of U.S. Provisional Application No. 62/133,073, filed on Mar. 13, 2015, the disclosure of which are expressly incorporated herein by reference in their entirety.

TECHNICAL FIELD

This specification relates to clasp mechanisms for wristwatch bands.

BACKGROUND

A wristwatch timepiece may include an electrical or mechanical display portion and supporting electrical or mechanical elements that affect a display of the time by the display portion. The wristwatch timepiece may be accompanied by one or more wristwatch bands that are designed to secure the wristwatch timepiece to a user, for example, a wrist of the user. Connectors can attach a wristwatch band to a wristwatch timepiece. These connectors can be common points of failure in wristwatches. In addition, one may desire to change bands on a wrist watch. However, removal and replacement of traditional connectors often require the use of specialized jeweler tools or taking the watch to a jeweler.

SUMMARY

The subject matter of this specification relates to mechanisms for attaching a wristwatch band to a wristwatch timepiece.

In one aspect, the subject matter of the disclosure features a watch band. The watch band includes a strap and a clasp mechanism integrated with an end of the strap. The clasp mechanism includes a concave member defining a channel at the end of the strap and a cover plate. The cover plate is configured to move between (i) a first position in which the cover plate covers the channel, and (ii) a second position in which the cover plate is retracted to leave at least part of the channel uncovered by the cover plate.

This and other implementations can each optionally include one or more of the following features. In some cases, the clasp mechanism can include a slider mechanism that is coupled to the cover plate and that is configured to cause the cover plate to move between the first and the second positions. The slider mechanism can extend through a slot in a surface of the strap. The slider mechanism can be a grip that is flush with a surface of the strap.

In some implementations, the cover plate can be at least partially covered by the strap. The cover plate can be at least partially within an interior of the strap and the slider mechanism extends from the cover plate in the interior of the strap past a surface of the strap.

In some implementations, the clasp mechanism can include one or more springs configured to retain the cover plate in the first position when the cover plate has been moved to the first position, and to retain the cover plate in the second position when the cover plate has been moved to the second position. The clasp mechanism can include first and second walls the first and second walls having a first and a second pair of corresponding detents, and a pair of spring arms attached to respective sides of the cover plate. Each of the spring arms can be biased in a direction against a respective one of the first and second walls, and each of the spring arms can include a protrusion configured to engage with the detents in the respective one of the first and second walls. The first pair of detents can be positioned along the first and second walls to retain the cover plate in the first position when the protrusions of the spring arms are engaged with the first pair of detents. The second pair of detents can be positioned along the first and second walls to retain the cover plate in the second position when the protrusions of the spring arms are engaged with the second pair of detents.

The clasp mechanism can include a spring configured to retain the cover plate in the first position. The spring can be a compression spring positioned between a back wall of the clasp mechanism and the cover plate such that movement of the cover plate from the first position to the second position compresses the spring.

The clasp mechanism can be metal injection molded. The clasp mechanism can be made from folded sheet metal. The clasp mechanism can include a ramp extending away from the concave member in a direction along a length of the strap, where at least a portion of the ramp spans a void.

In another aspect, the subject matter of the disclosure features a watch. The watch includes a watch module with first and second bars, and first and second watch bands. Each of the first and second watch bands include a strap and a clasp mechanism a clasp mechanism integrated with an end of the strap. The clasp mechanism includes a concave member defining a channel at the end of the strap, a cover plate, and a slider mechanism. The cover plate is configured to move between (i) a first position in which the cover plate covers the channel, and (ii) a second position in which the cover plate is retracted to leave at least part of the channel uncovered by the cover plate. The slider mechanism is coupled to the cover plate and configured to cause the cover plate to move between the first and the second positions.

Particular implementations of the subject matter described in this specification can be implemented so as to realize one or more of the following advantages. Implementations may improve the ease of swapping out watch bands over traditional band clasp designs. A wristwatch wearer may be able to remove and attach watch bands without the use of tools. A wearer may be able to readily swap watch bands between traditional analog or digital watches and recent smart watches.

The details of one or more implementation of the subject matter described in this specification are set forth in the accompanying drawings and the description below. Other potential features, aspects, and advantages of the subject matter will become apparent from the description and the drawings.

BRIEF DESCRIPTION OF THE DRAWINGS

FIGS. 4E-A, 4E-B, 4E-C, and 4E-D depict views of an example watch band clasp mechanism according to a third implementation of the present disclosure.

Like reference numbers and designations in the various drawings indicate like elements.

DETAILED DESCRIPTION

Implementations of the present disclosure are generally directed to tool-free watch band attachment mechanisms for wristwatches. Some implementations include mechanisms that are compatible with existing timepiece connector designs. Some implementations include mechanisms that are compatible with existing timepiece lug connection designs. Some implementations include mechanisms that attach to traditional spring bars. In some implementations, a watch band or watch module includes a release mechanism that can be operated by feel, without looking at the watch band. Implementations of the present disclosure are adapted for use with standard size wristwatch strap components such as, for example, standard 16 mm, 18 mm, and 22 mm spring bars and corresponding watch module lugs. In some cases such adaptations permit the clasp mechanisms to be compatible with a wide variety of both traditional analog or digital watches and smart watches.

As used herein, the terms "parallel" and "perpendicular" are not limited to their strict geometric definitions, but include reasonable tolerances for machining or human errors and inconsistencies.

Figure 1A:
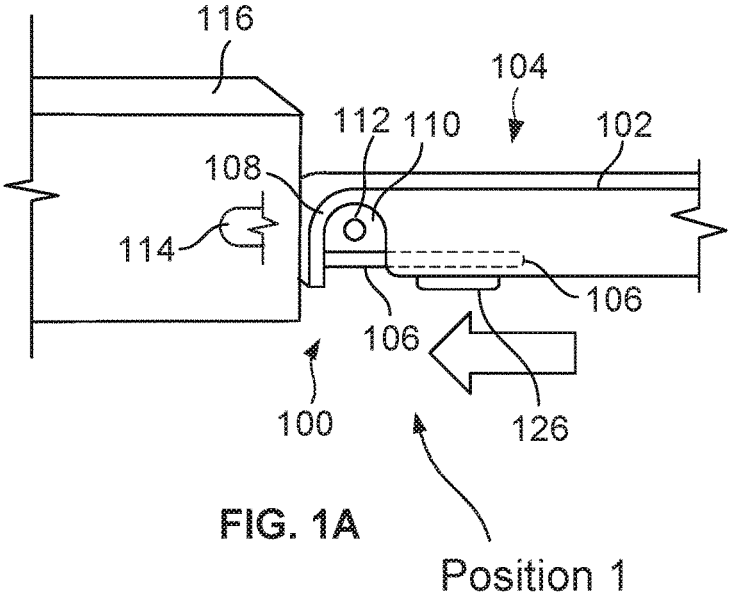
FIGS. 1A-1N depict various views of an example watch band clasp mechanism according to a first implementation of the present disclosure.
Figure 1B:
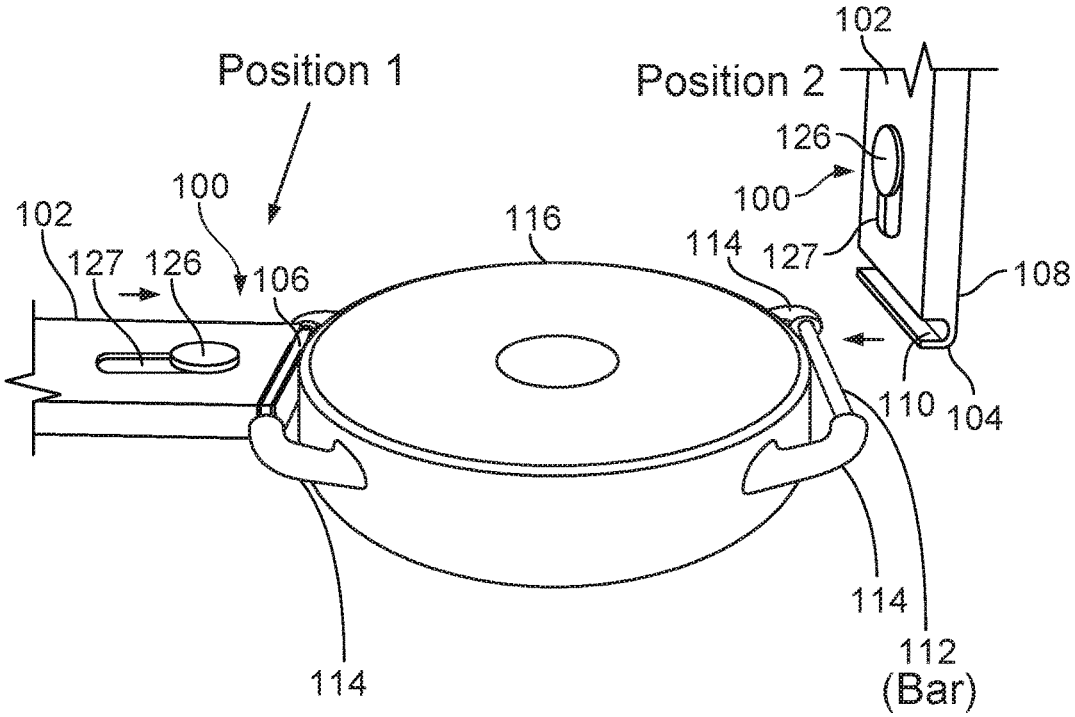

FIGS. 1A and 1B depict perspective views of an example watch band clasp mechanism 100 according to a first implementation of the present disclosure. The clasp mechanism 100 is integrated into a strap 102 at one end 104 of the strap 102, and includes a moveable cover plate 106 and a concave member 108 defining a channel 110. The cover plate 106 is at least partially enclosed within the strap 102 and can slide between a first (closed) position (Position 1) and a second (open) position (Position 2). The clasp mechanism 100 can be used to attach watch straps 102 to a watch module 116. A watch module 116 can be an analog timepiece, a digital timepiece, or a smart watch module. The clasp mechanism 100 attaches to one of two bars 112, e.g., traditional spring bars, extending between a pair of spring bar lugs 114 on either side of a watch module 116. The channel 110 defined by the concave member 108 is configured to accept one of the bars 112 on the watch module 116.

In the first position, the cover plate 106 covers the channel 110, thereby, restraining the watch module bar 112 within the channel 110, and attaching the watch band to the watch module 116. In the second position, the channel 110 is, at least partially, uncovered by the cover plate 106, thereby, permitting the watch module bar 112 to be inserted or removed from the channel 110, and, hence, permitting the straps 102 to be removed from or attached to the watch module 116. In some examples, the cover plate 106 is retained in the first position by the force of one or more springs. In some examples, the cover plate 106 is retained in the second position by the force of one or more springs.

Figure 1C:
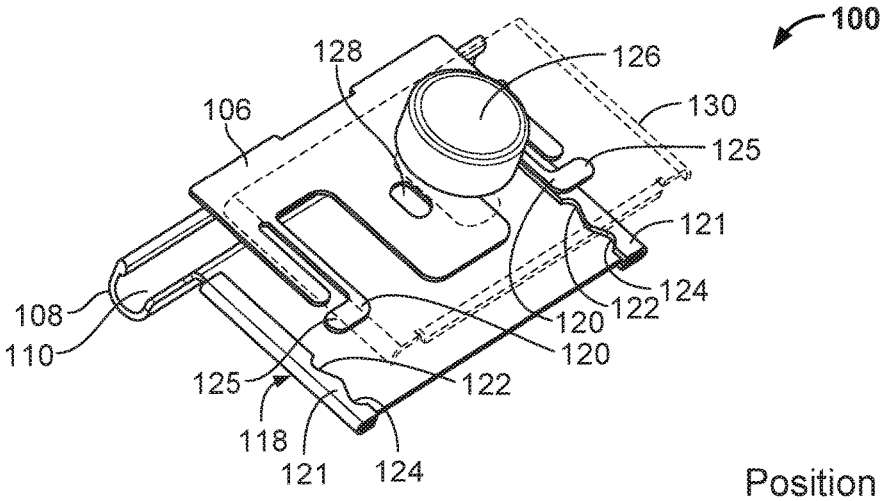
Figure 1D:
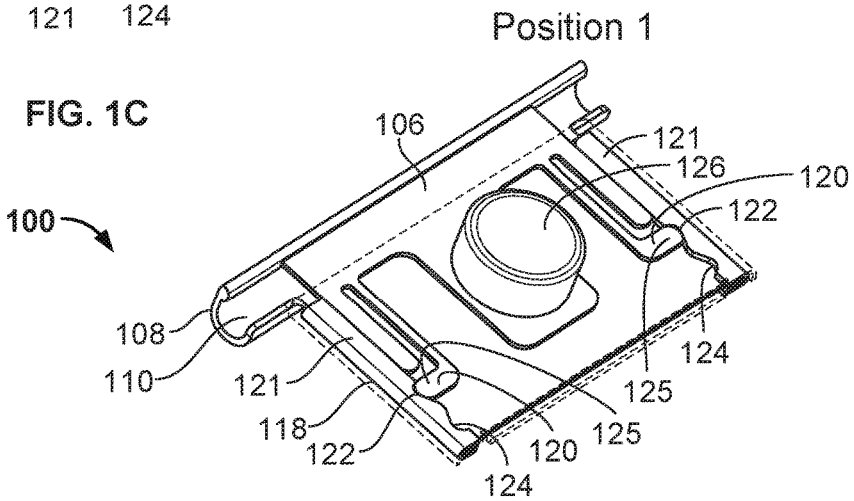
Figure 1E:
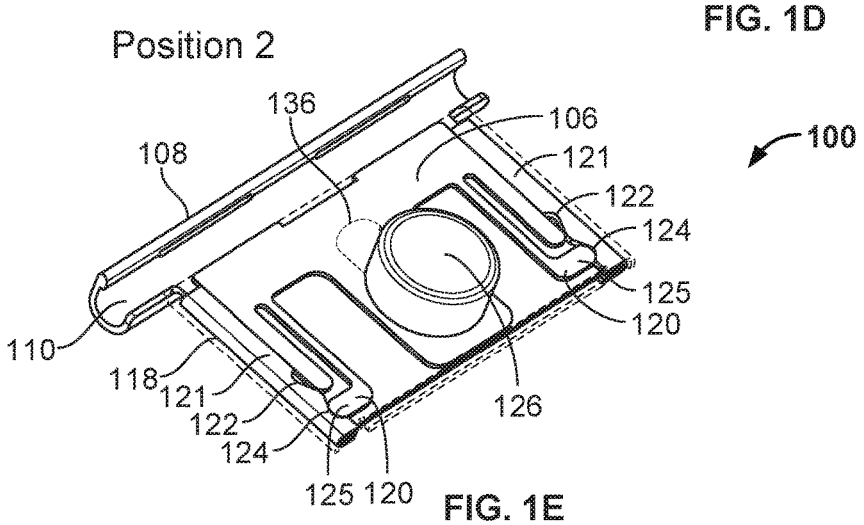

FIGS. 1C-1E depict internal views of an example watch band clasp mechanism 100 according to a first implementation of the present disclosure. As shown in FIGS. 1C-1E, the claps mechanism 100 further includes a housing 118. In the example shown, the concave member 108 is attached to one end of the housing 118. In some examples, the housing 118 is inserted within an end of a watch strap (e.g., strap 102 of FIGS. 1A and 1B). In some implementations, an elastomer or polymer watch strap can be molded around the housing. In some implementations, a leather or cloth watch strap can be stitched around the housing. In some implementations, the housing 118 can be integral with a watch strap. In other words, the housing 118 can be formed of the same material as the strap. In some implementations, the housing 118 can be integrated into a metal watch band.

Furthermore, the housing 118 includes side walls 121 enclosing the cover plate 106 on the sides. The cover plate 106 is free to slide in a direction parallel (e.g., substantially parallel) with the side walls 121. The cover plate 106 includes a pair of spring arms 120, each having a protrusion 125 that faces a corresponding one of the side wall 121. In addition, there are two detent pairs (122, 124) in the housing 118 side walls 121 that correspond with the protrusions 125 on the cover plate 106 spring arms 120. The spring arm 120 protrusions 125 and detent pairs 122, 124 are shaped to engage with each other. The spring arms 120 are biased with a spring force directed towards the side walls 121 of the housing 118. When engaged with one of the detent pairs 122, 124, the spring arm 120 protrusions 125 retain the cover plate 106 in either the first (closed) or second (open) position, thereby preventing inadvertent movement of the cover plate 106. A force, e.g., from a user, is required to overcome the spring arm bias force that maintains engagement between the protrusions 125 and the detents and move the cover plate 106 from one position to the other.

For example, detent pair 122 corresponds to the first (closed) position, and detent pair 124 corresponds to the second (open) position. In other words, the length of the cover plate 106 and the position of the first detent pair 122 along the housing 118 side walls 121 are configured such that when the spring arm 120 protrusions 125 are engaged with the first detent pair 122, the cover plate 106 is retained in the first position, extending over the channel 110 (FIG. 1D). Correspondingly, the length of the cover plate 106 and the position of the second detent pair 124 along the housing 118 side walls 121 are configured such that when the spring arm 120 protrusions 125 are engaged with the second detent pair 124, the cover plate 106 is retained in the second position, at least partially uncovering the channel 110 (FIG. 1E).

Referring to FIGS. 1B and 1C, a slider mechanism 126 is attached to the cover plate 106 at an attachment location 128. Still referring to FIGS. 1A and 1B, the slider mechanism 126 may be, for example, a knob, button, grip, or other appropriate structure that permits a user to move the cover plate 106 between the first and second positions. For example, in some implementations, the slider mechanism 126 can extend through respective slots 127 in a surface of each of the straps 102. In some implementations, the slider mechanism 126 can extend through the slot 127 and past the surface of the strap 102. In some implementations, the slider mechanism 126 can extend through the slot 127 such that an outer surface of the slider mechanism 126 is flush or approximately flush with the surface of the strap 102. In some implementations, the slider mechanism 126 may have a textured surface, for example, to provide a user with additional grip on the slider mechanism 126.

Referring again to FIGS. 1C-1E, in some implementations, the clasp mechanism 100 includes a housing cover 130 which is positioned over the housing 118. The housing cover 130 includes a slot 136. The slot 136 in the housing cover 130 is aligned with the slot 127 in the strap 102 (FIG. 1B). In some implementations, a portion of the slider mechanism 126 extends through the slot 136 and is attached to the cover plate 106 at the attachment location 128. In some implementations, a fastener, e.g., a rivet, a weld bead, a screw, etc., is passed through the slot 136 to attach the slider mechanism 126 to the cover plate 106.

In some implementations, the various parts of the claps mechanism 100 are attached by means of welding (e.g., laser welding). For example, the housing 118 and the housing cover 130 can be welded together along the outer edges of the housing 118 side walls 121. Similarly, for example, the slider mechanism 126 can be welded to the cover plate 106 at the attachment point 128. In some implementations, the clasp mechanism 100, or various parts of the clasp mechanism 100 are metal injection molded (MIM). For example, one or more of the clasp mechanism housing 118, the cover plate 106, and the housing cover 130 may be made by a MIM process. In some implementations, the clasp mechanism 100, or various parts of the clasp mechanism 100 are made from sheet metal. For example, one or more of the clasp mechanism housing 118, the cover plate 106, and the housing cover 130 may be made of bent sheet metal.

Figure 1F:
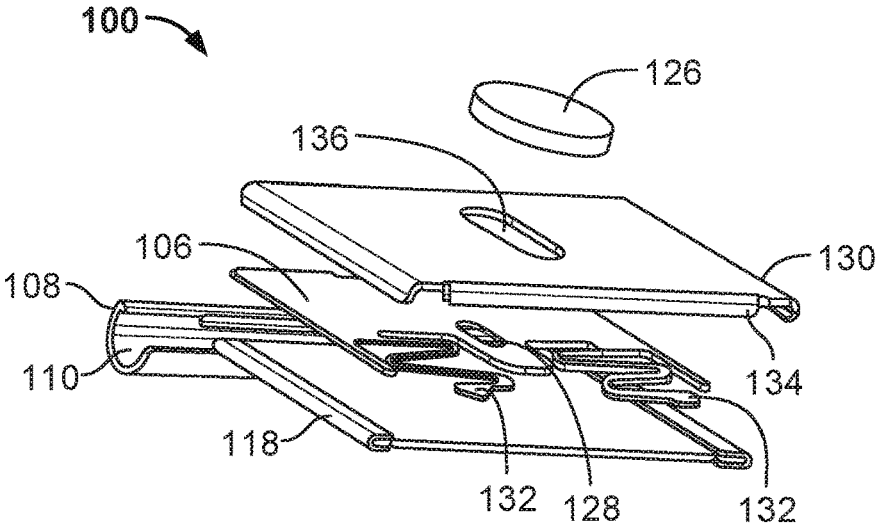
Figure 1G:
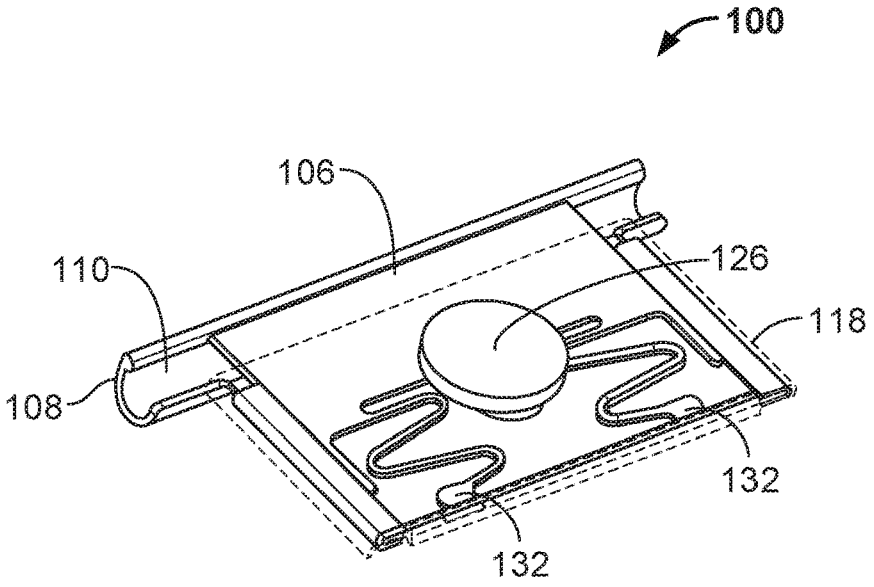

FIGS. 1F and 1G depict internal views of an example watch band clasp mechanism 100 according to a first variation of the first implementation of the present disclosure. According to the first variation shown in FIGS. 1F and 1G, the spring arms 120 of the cover plate 106 are replaced by one or more compression springs 132. The compression springs 132 extend from a rear edge of the cover plate 106 and abut a back wall 134 of the housing cover 132. The back wall 134 extends from the housing cover 132 in a direction towards the housing 118 so as to enclose the cover plate 106 and compression springs 132 within the assembled housing 118 and housing cover 130. In some implementations, the back wall 134 may be attached to or integral with the housing 118 instead of the housing cover 130. For example, the back wall 134 may extend from the housing 118 in a direction towards the housing cover 130 so as to enclose the cover plate 106 and compression springs 132 within the assembled housing 118 and housing cover 130.

The compression springs 132 exert a force against the back wall 134 in a direction parallel (e.g., substantially parallel) to the side walls 118, thereby biasing the cover plate 106 in the first (closed) position. A user may move cover plate 106 to the second (open) position by exerting a force on the slider mechanism 126 in a direction opposite the spring force, thereby compressing the compression springs 132 and causing the cover plate 106 to move into the second (open) position. Upon the removal of the user exerted force, the compression springs 132 cause the cover plate 106 to return to the first (closed) position.

Although the compression springs 134 are illustrated as being integral with the cover plate 106, in some implementations, the compression springs 134 may be separate components installed between the cover plate 106 and the back wall 132.

Figure 1H:
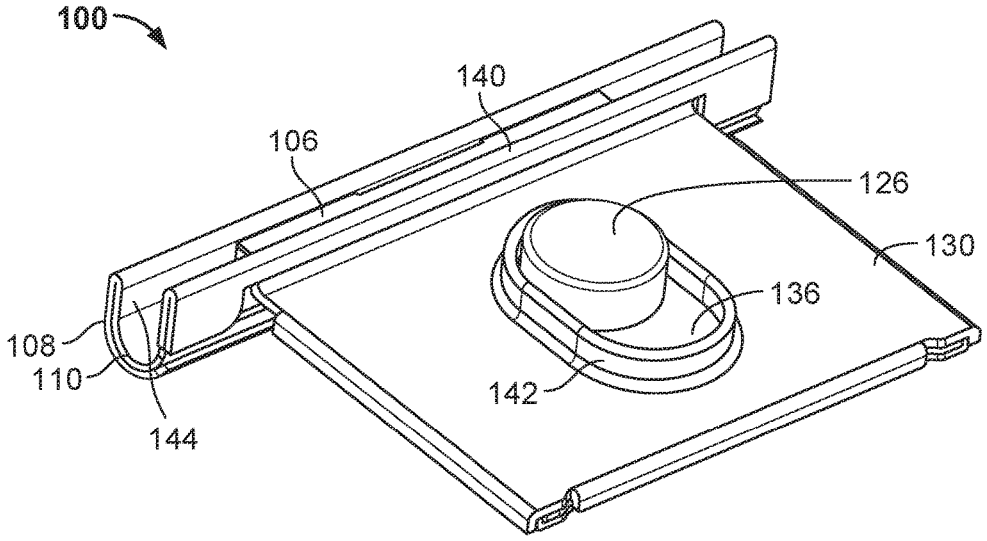
Figure 1I:
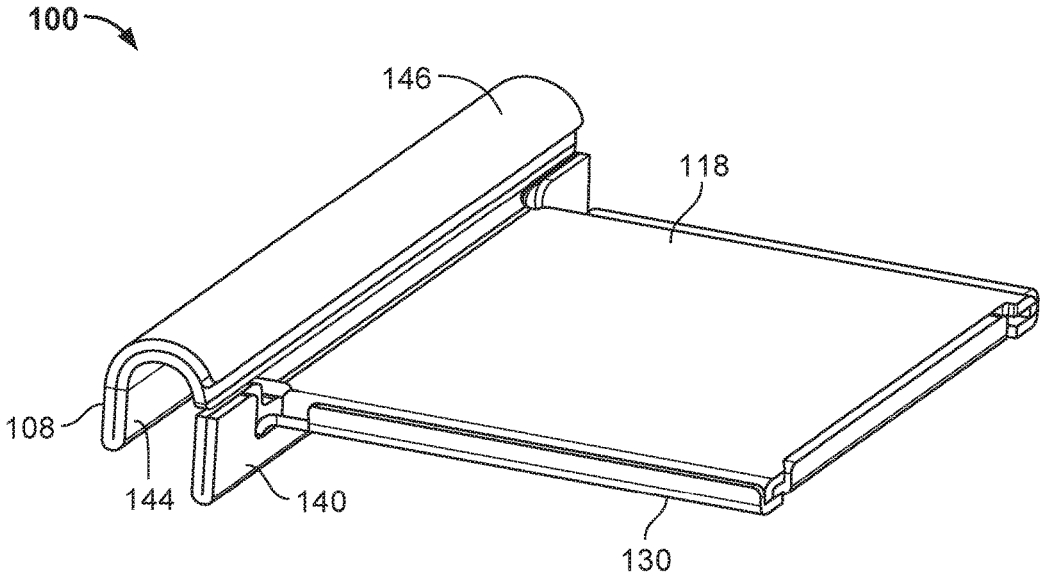

FIGS. 1H and 1I depict external views of the example watch band clasp mechanism 100 according to a second variation of the first implementation of the present disclosure. According to the second variation shown in FIG. 1H, the housing cover 130 can include a wall 140 extending outward from an outer surface of the housing cover 130. In addition, the housing cover 130 can include a collar 142 extending outward from the outer surface of the housing cover 130. The collar 142 surrounds the slot 136 for the slider mechanism 126. The wall 140 and the collar 142 may serve to protect the strap 102 from damage or excessive wear.

Referring to FIGS. 1H and 1I, in some implementations, tooling can be inserted within the channel 110 and used to create a ledge or groove (not shown) on an inner surface 144 of the concave member 108 of the clasp mechanism housing 118. The edge of the cover plate 106 may rest on the ledge (or within the groove) on the inner surface 144 of the concave member 108. The ledge or groove and the cover plate 106 can be configured such that when the edge of the cover plate 106 rests on the ledge (or within the groove), the cover plate 106 is prevented from flexing in a direction perpendicular to the length of the channel 110.

As shown in FIG. 1I, the concave member 108 of the clasp mechanism housing 118 can include a folded back portion 146 wrapped back around the outer surface of the concave member 108. For example, the folded back portion 146 may increase the strength of the concave member 108 in sheet metal implementations of the clasp mechanism 100.

Figure 1J:
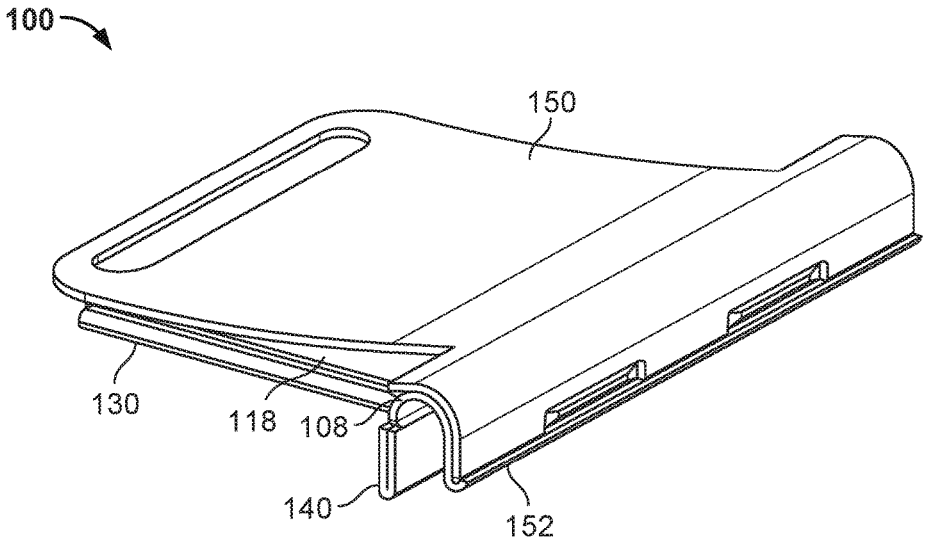
Figure 1K:
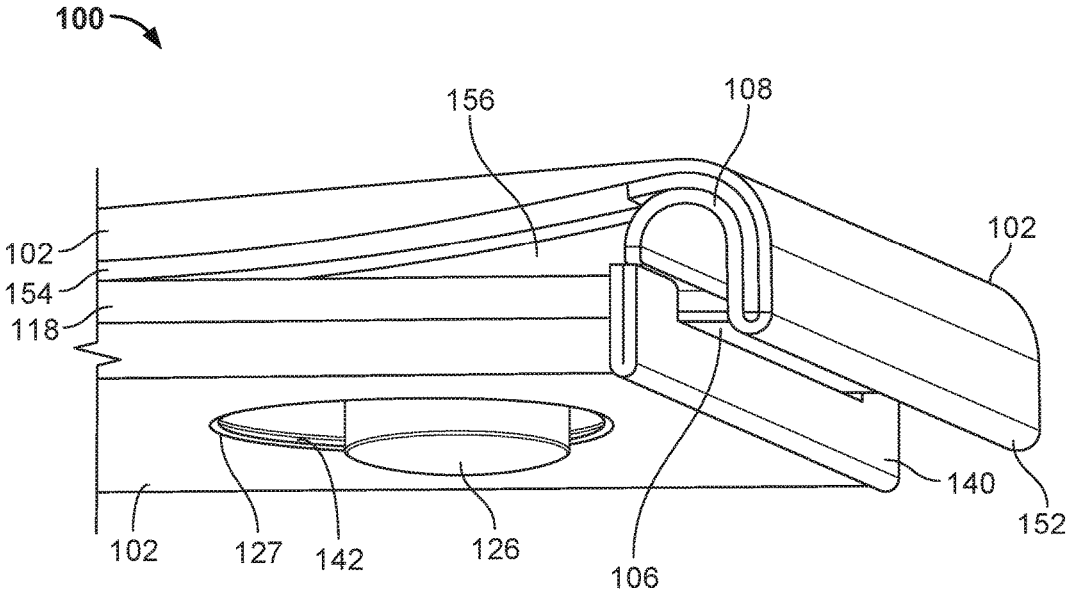

FIG. 1J depicts an external view of the example watch band clasp mechanism 100 according to a third variation of the first implementation, and FIG. 1K depicts a cutaway view of the example watch band clasp mechanism 100 according to the third variation of the first implementation. According to the third variation shown in FIGS. 1J and 1K, the clasp mechanism 100 can include a ramp 150 extending from the concave member 108 along a portion of the length for the strap 102. The ramp 150 at least partially wraps around the outer surface of the concave member 108 and extends away from the concave member 150 along the length of the strap 102. The ramp 150 creates a larger surface area for bonding the strap 102 to the clasp mechanism housing 118 in an area near the concave member 108. As shown in FIG. 1K, the ramp 150 provides a surface area for a bonding material 154 (e.g., an adhesive) to attach the strap 102 to the clasp mechanism 100 by spanning the void 156 created by wrapping the strap around the concave member 108.

Referring again to FIGS. 1J and 1K, the concave member 108 also includes a loop portion 152. The loop portion 152 extends outward slightly from the outer surface of the concave member 108 past the edge of the ramp 150 and mates with an edge of the strap 102. The loop portion 152 may protect the edge of the strap 102 from damage or excessive wear. In addition, FIG. 1K shows the slot 127 in the strap 102 mated with the collar 142, and an edge of the strap 102 mated with the wall 140. The collar 142 and the wall 140 can, in some examples, be flush with an outer surface of the strap 102, or extend slightly past the outer surface of the strap 102.

Figure 1N:
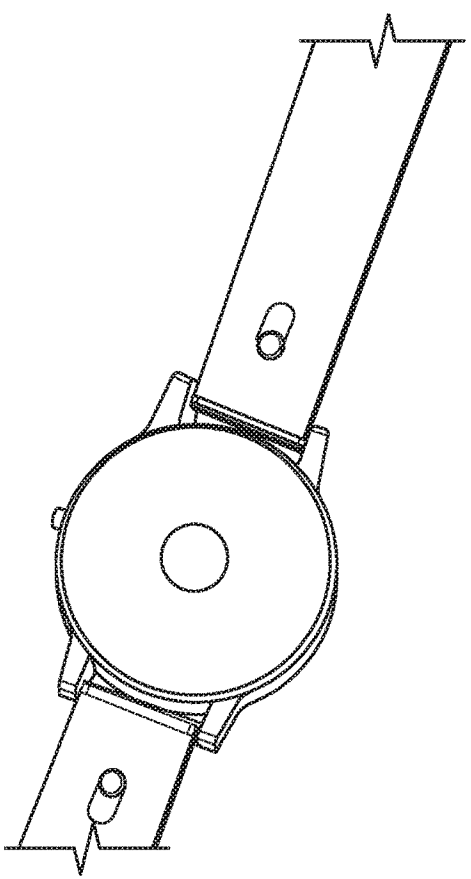
Figure 1M:
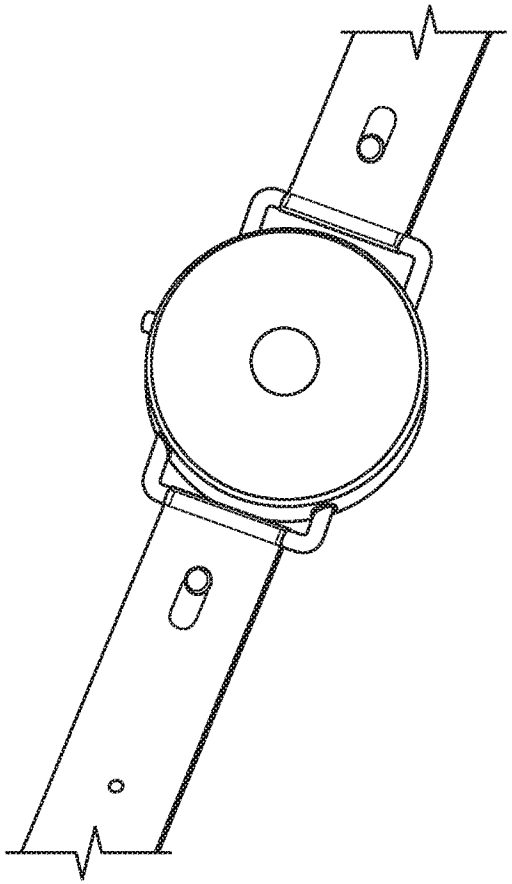
Figure 1L:
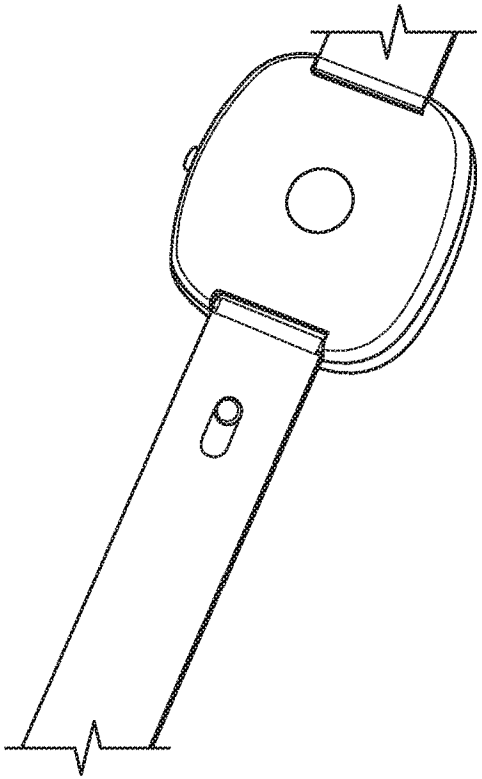

FIGS. 1L-1N depict several example timepiece lug 114 designs for use with watch band 102 clasp mechanisms 100 according to the first implementation of the present disclosure.

Figure 2:
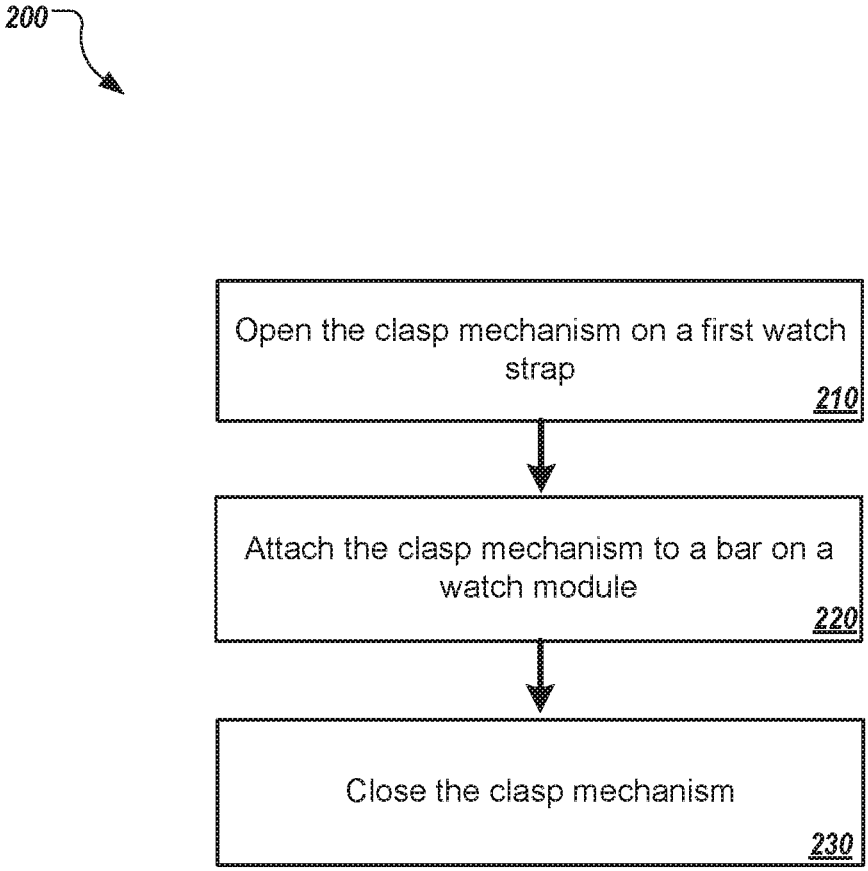
FIG. 2 depicts an example method of attaching a watch band to a watch module that can be performed with implementations of the present disclosure.

FIG. 2 depicts an example method 200 of attaching a watch band to a watch module that can be performed with implementations of the present disclosure. For example, the method 200 can be performed to attach a watch band having a clasp mechanism, such as one of the variations of claps mechanism 100 described above, to a watch module. To attach a first watch band to a watch module, a clasp mechanism of the first watch strap is opened (210). For example, the clasp mechanism may be integrated with an end of the watch strap and may include a concave member defining a channel at the end of the strap, and a cover plate configured to move between a first (closed) position and a second (open) position. In the first position, the cover plate may cover the channel, and, in the second position, the cover plate may be, at least partially, retracted into the watch strap so as to leave at least part of the channel uncovered. Furthermore, opening the clasp mechanism may be performed by moving the cover plate from the first position to the second position. In some examples, the cover plate may be moved from the first position to the second position by providing a first user force in a direction parallel (e.g., substantially parallel) to the length of the watch strap.

The clasp mechanism is attached to a watch module (220). For example, watch clasp mechanism can be attached to a watch module by inserting a bar attached to the watch module into the channel of clasp mechanism or vice versa. The clasp mechanism is closed to retain the bar within the channel (230). For example, the clasp mechanism can be closed by providing a second user force in second direction opposite (e.g., anti-parallel) to the first direction to move the cover plate from the second (open) position to the first (closed) position. In some examples, the clasp mechanism can be closed by removing the first user force and permitting a spring force in a second direction substantially opposite to the first direction to move the cover plate from the second (open) position to the first (closed) position. The spring force can be provided by a spring within the clasp mechanism.

The method 200 can be repeated to attach a second watch strap to the watch module. In addition, the method 200 can also be performed to remove a watch strap from a watch module with the expectation that at step (220) instead of inserting the bar attached to the watch module into the channel of clasp mechanism, the bar would be removed from the channel.

Figure 3A:
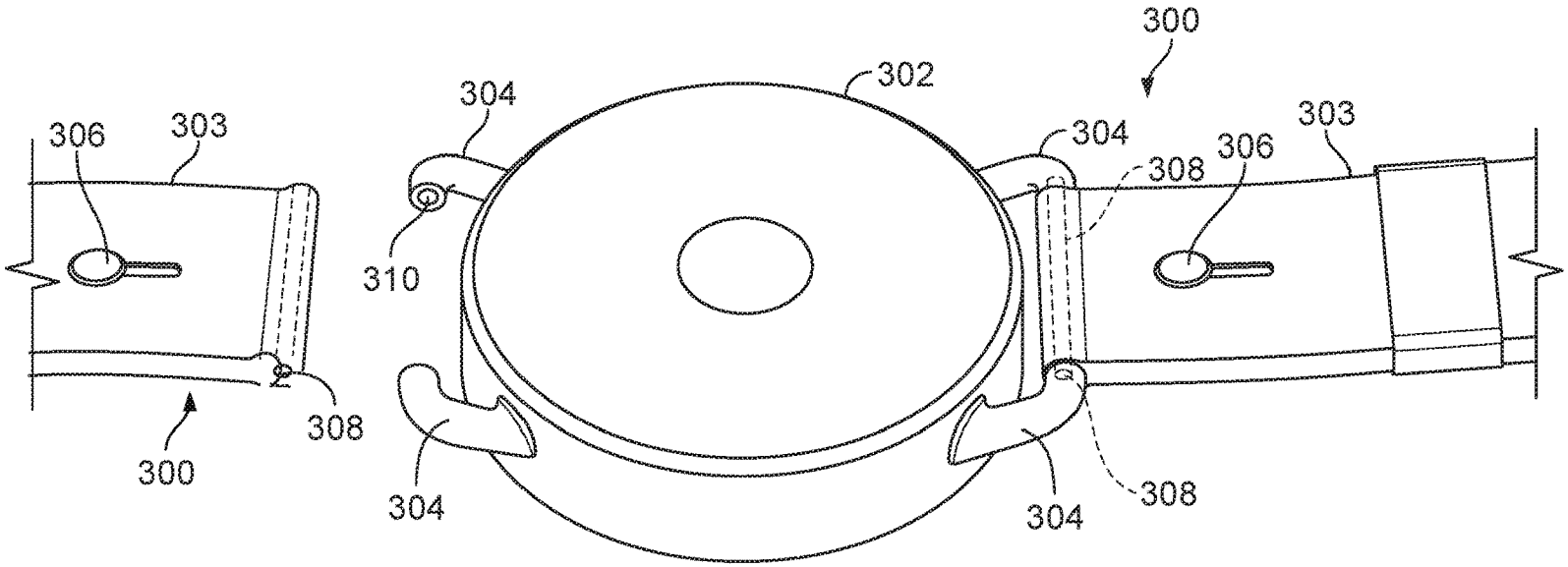
FIGS. 3A-3E depict views of an example watch band clasp mechanism according to a second implementation of the present disclosure.

FIG. 3A depicts an example watch band 303 clasp mechanism 300 according to a second implementation of the present disclosure. The clasp mechanism 300 of FIG. 3A includes a watch module 302 with a pair of spring bar lugs 304 extending from one or both sides of the watch module, and two bands 303, each having a pair of retractable spring pins 308 and a spring pin release mechanism 306. The spring pin release mechanism 306 allows spring pins 308 to be retracted into the clasp mechanism 300, for example, by sliding a spring pin release mechanism 306 in a direction parallel (e.g., substantially parallel) to the watch band 303 (and perpendicular (e.g., substantially perpendicular) to an axis of the pins 308). The band 303 is attached to the watch module 302 by inserting the spring pins 308 in corresponding detents 310 on the lugs 304. When installed the, spring pins 308 are forced into the detents 310 under spring pressure. Sliding the spring pin release mechanism 306 against the spring pressure retracts the spring pins 308 at least partially into the clasp mechanism 300 and out of the detents 310. Variations of the third implementation may be compatible with existing spring bar lugs 304, thereby making it easy and affordable to change the look of a watch.

Figure 3B:
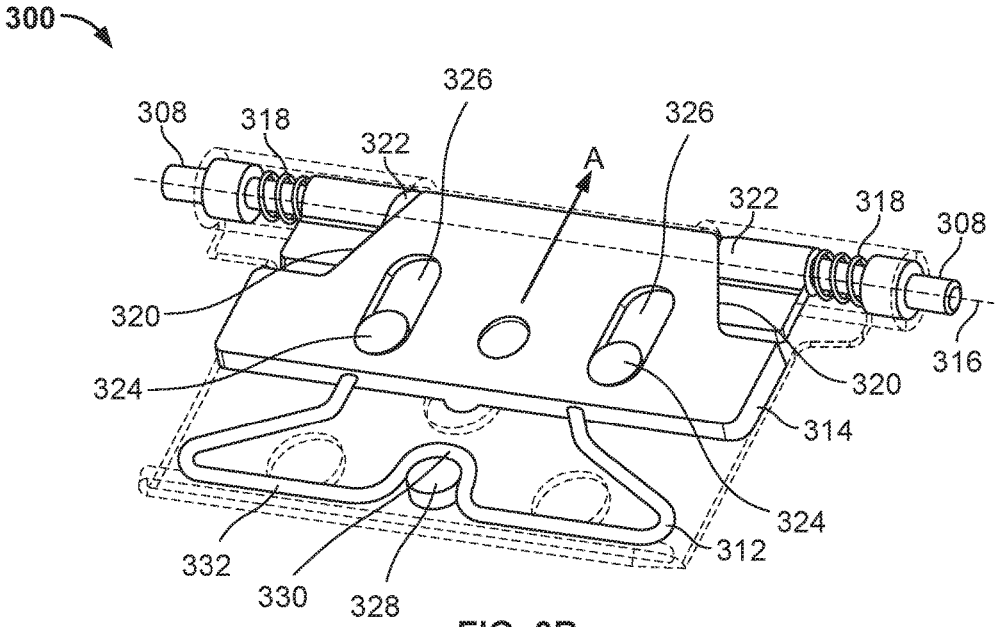
Figure 3C:
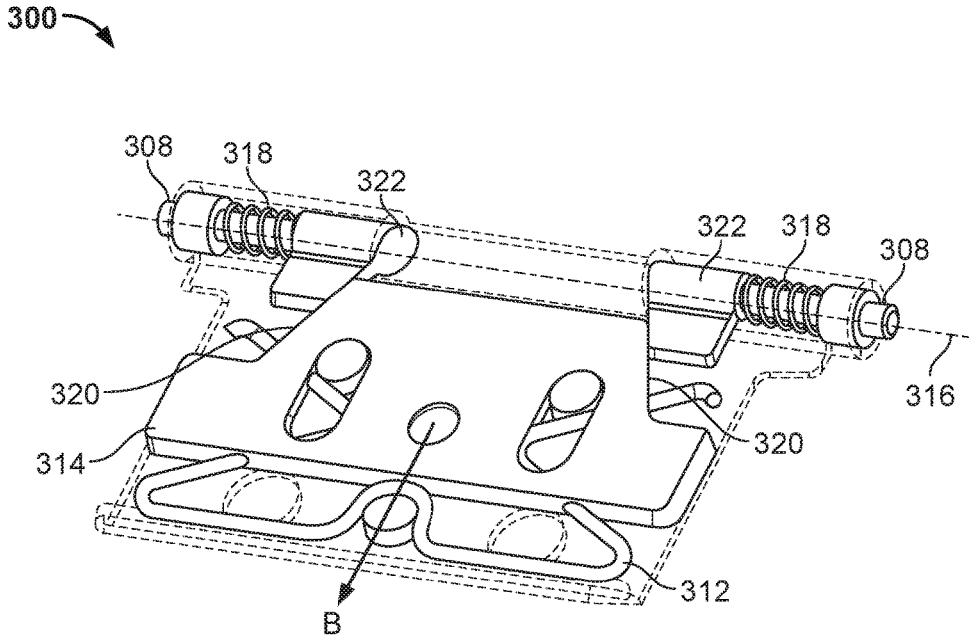

FIGS. 3B and 3C depict internal views of an example watch band 303 clasp mechanism 300 according to the second implementation of the present disclosure. FIGS. 3B and 3C show one implementation of a spring pin release mechanism 306. A main spring 312 biases a slider plate 314 in direction (A), perpendicular (e.g., substantially perpendicular) to an axis 316 of the spring pins 308. The canted edges 320 of the slider plate 314 contact corresponding canted edges 322 extending from the spring pins 308, thereby, forcing the spring pins 308 to extend outwards from the clasp mechanism 300. When the slider plate 314 is moved, e.g., by a user provided force, in direction (B), the cant angle of the canted edges 320, 322 of the slider plate 314 and spring pins 308 permit the pins 308 to be retracted at least partially into the clasp mechanism 300 under the force of the coil springs 318. The force of the coil springs 318 alone, however, may not be sufficient to move the slider plate 314 in direction (B) against the force of the main spring 312.

In some implementations, the clasp mechanism 300 includes guide posts 324 and corresponding guides slots 326 in the slider plate 314. In some implementations the, clasp mechanism 300 does not include the guide posts 324 guide slots. In some implementations, the clasp mechanism 300 includes a spring retention post 328 and a base portion 332 of the main spring 312 includes a U-shaped portion 330 that engages the spring retention post 328. In implementations of the clasp mechanism 300 that do not include the spring retention post 328, the main spring 312 is straight along the base portion 332 and does not have the U-shaped portion 330.

Figure 3D:
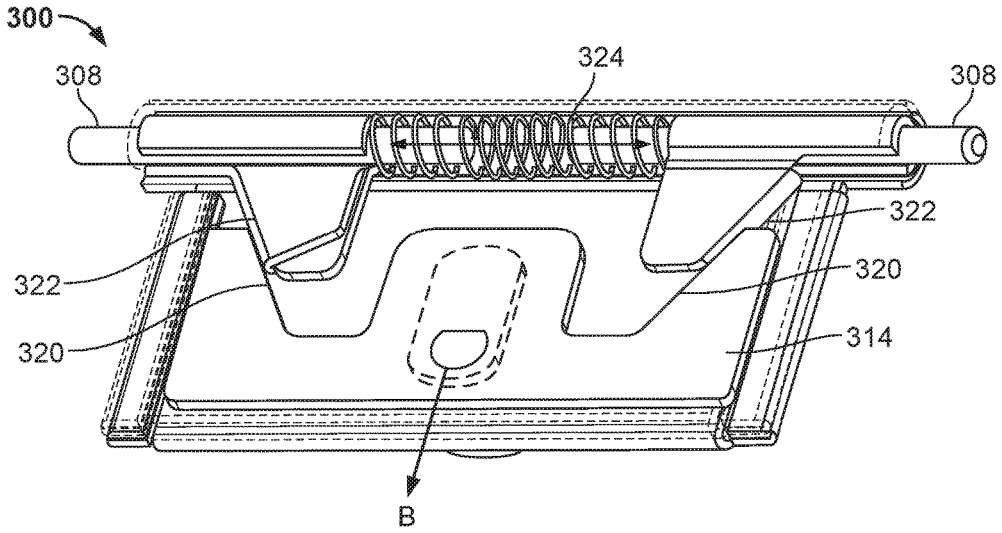
Figure 3E:
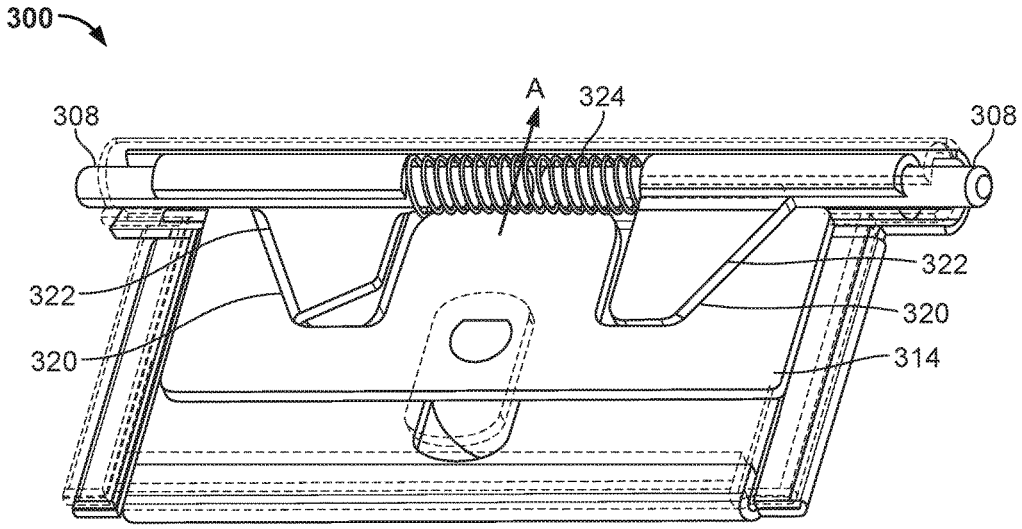

FIGS. 3D and 3E depict internal views of an example watch band 303 clasp mechanism 300 according to a variation of the second implementation of the present disclosure. FIGS. 3D and 3E show another implementation of a spring pin release mechanism 306. The depicted implementation of the spring pin release mechanism 306 functions in a similar way to that described above, but with the slider plate 314 moving in the opposite direction to retract the spring pins 308. More specifically, the spring pins 308 are extended from the clasp mechanism 300 when the slider plate 314 is moved in direction (B), and the spring pins 308 are, at least, partially retracted into the clasp mechanism 300 when the slider plate 314 is moved in direction (A). The coil spring 324 provides an outward axial force on the spring pins 308 that biases the spring pins 308 in the extended position. By way of the canted edges 320 of the slider plate 314 and the canted edges 322 extending from the spring pins 308 and the slider plate 314, the force of the coil spring 324 is transferred to the slider plate 314, thereby biasing the slider plate 314 in direction (B). The spring pins 308 can be retracted by providing a user force to move the slider plate 314 in direction (A). The user force is translated through the canted edges 320 of the slider plate 314 to the canted edges 322 of the spring pins, and overcomes the force of the coil spring 324 to cause the spring pins 308 to retract at least partially into the clasp mechanism 300.

Figure 3H:
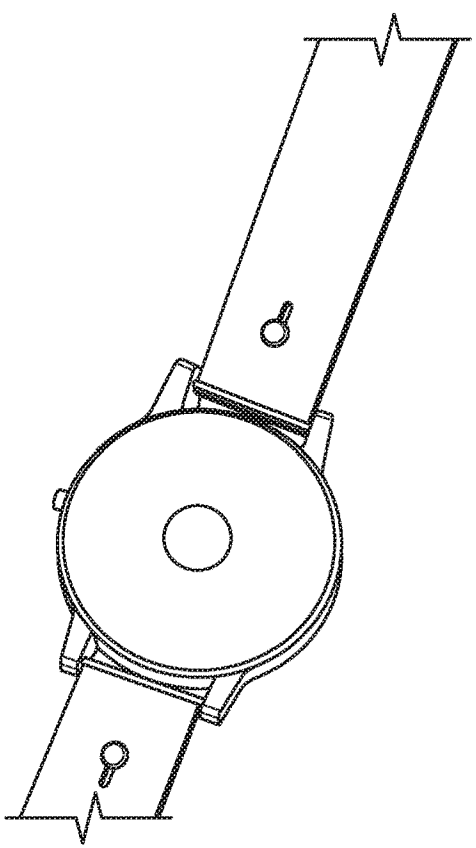
FIGS. 3F-H depict multiple example timepiece lug designs for use with watch band clasp mechanisms, according to the second implementation of the present disclosure.
Figure 3G:
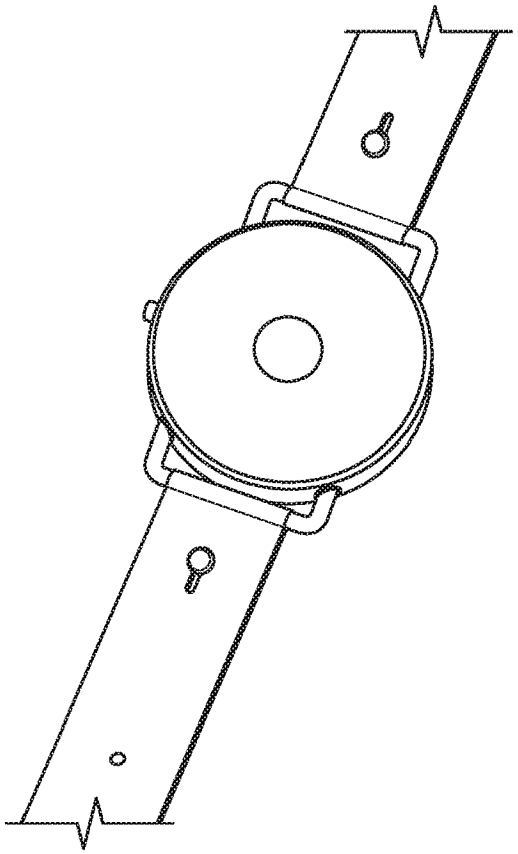
Figure 3F:
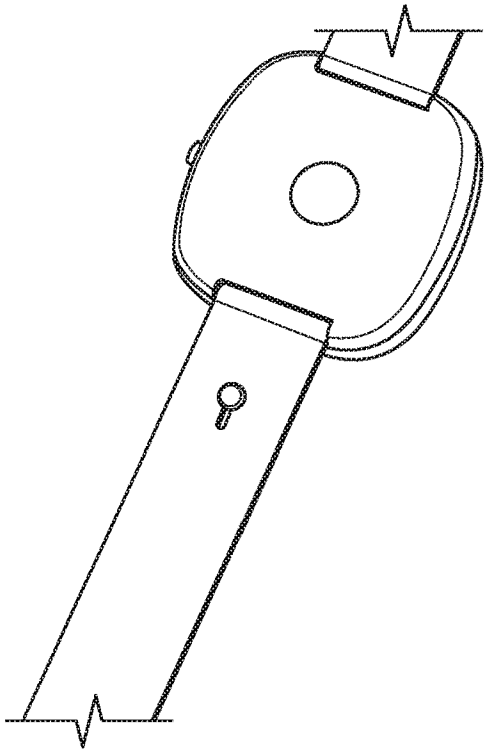

FIGS. 3F-3H depict several example timepiece lug 304 designs for use with watch band 303 clasp mechanisms 300 according to the second implementation of the present disclosure.

Figure 4A:
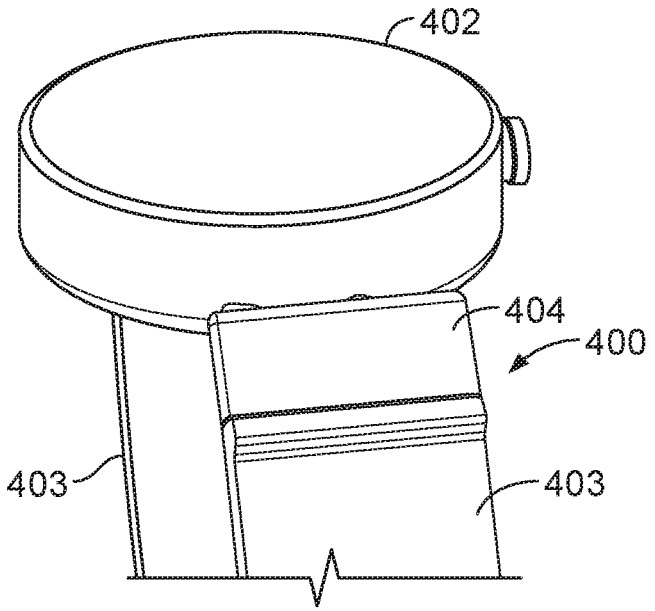
FIGS. 4A-4D depict views of an example watch band clasp mechanism according to a third implementation of the present disclosure.
Figure 4B:
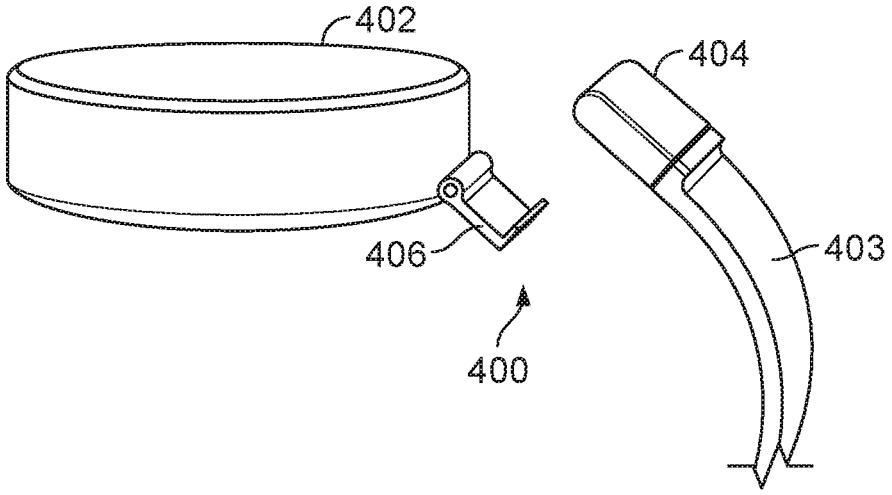
Figure 4C:
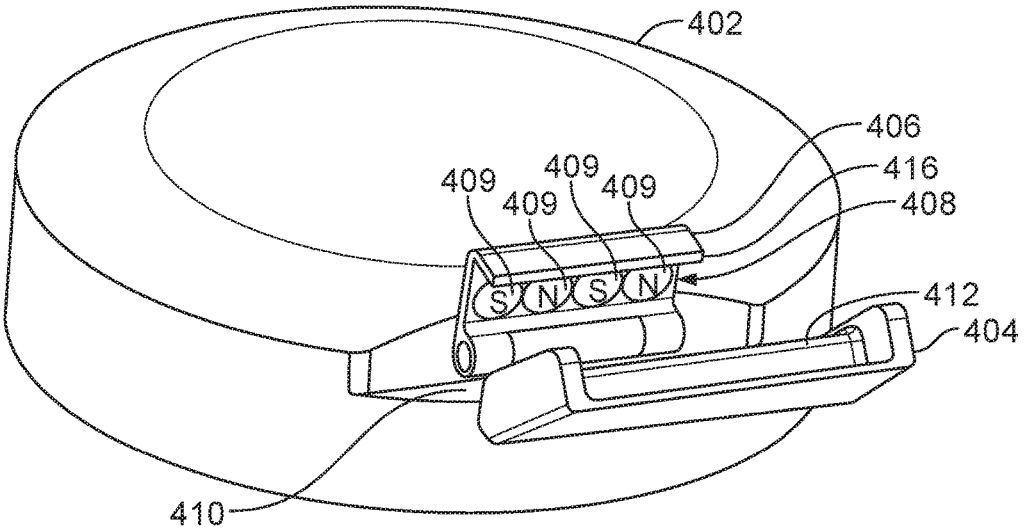
Figure 4D:
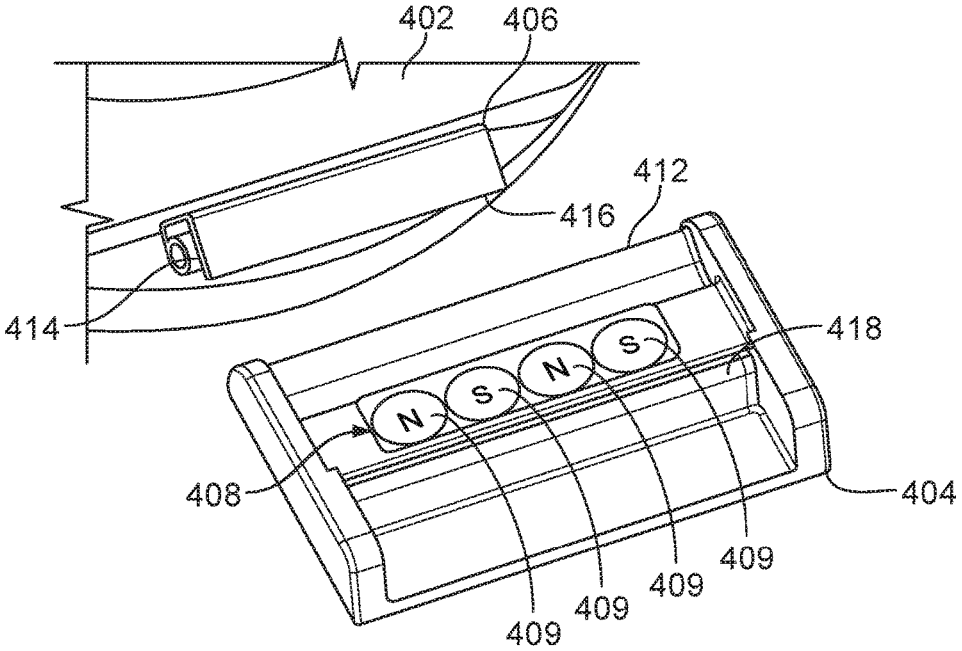

FIGS. 4A and 4B depict views of an example watch band clasp mechanism 400 according to a third implementation of the present disclosure. The clasp mechanism 400 of FIGS. 4A and 4B includes a watch module 402 with a pivotable pawl 406 on either side of the watch module, and a corresponding clasp 404 at the end of the band 403. FIGS. 4C-4D depict various detail views of an example clasp mechanism 400 according to the third implementation of the present disclosure. The pawl 406 and the clasp 404 include arrays 408 of magnets 409 arranged such that, when the clasp 404 is attached to the pawl 406 the north poles (N) of the corresponding magnets 409 in the clasp 404 align with the south poles (S) of the magnets 409 in the pawl 406 and the south poles (S) of the magnets 409 in the clasp 404 align with the north poles (N) of the corresponding magnets 409 in the pawl 406, and thereby, locking the clasp 404 to the pawl 406. The clasp 404 includes clasp end tab 412 which is inserted within a corresponding slot 410 in the watch module, e.g., the watch body slot, and underneath the pawl hinge 414. The pawl 406 includes a lip 416 at one end that snaps over a corresponding lip 418 in the clasp 404.

The clasp 404 is sufficiently wider than the pawl 406 to allow the clasp 404 to be translated with respect to the pawl 404 along a direction parallel (e.g., substantially parallel) to the width of the clasp 404. The clasp 404 is locked to the pawl 406 under the attractive force of the magnets 409 when corresponding north poles of the clasp 404 magnets 409 are aligned with south poles of the pawl 406 magnets 409 and vice versa. Translation of the clasp 404 causes the poles in the clasp 404 magnets 409 and pawl 406 magnets 409 to misalign. That is, translation of the clasp 404 causes the north poles of the clasp 404 magnets 409 to be aligned with the north poles of the pawl 406 magnets 409 and the south poles of the clasp 404 magnets 409 to be aligned with the south poles of the pawl 406 magnets 409, thereby, creating a repulsive force between the clasp 404 and the pawl 406, and unlocking the clasp 404 from the pawl 406. In some implementations the width of the clasp 404 is wider than the width of the pawl 406 by approximately twice the width, in some examples the diameter, of one of the magnets 409.

FIG. 4E depicts FIGS. 4E-A, 4E-B, 4E-C, and 4E-D depict an example process for unlatching an example watch band clasp mechanism 400 according to the third implementation of the present disclosure. At step A (FIG. 4E-A), the clasp 404 is locked to the pawl 406. At step B (FIG. 4E-B), a force is applied to the clasp 404 translating the clasp 404 with respect to the pawl 406. At step C (FIG. 4E-C), the translation causes the position of the magnets in the clasp to index by one, thus aligning repelling magnets 409 poles between the pawl 406 magnets 409 and the clasp 404 magnets 409. The repulsive force causes the pawl 406 to rotate away from the clasp 404. At step D (FIG. 4E-D), the pawl lip 416 disengages from the clasp 404 and the clasp end tab 412 may be withdrawn from the slot 410 in the watch module 402.

Figure 5A:
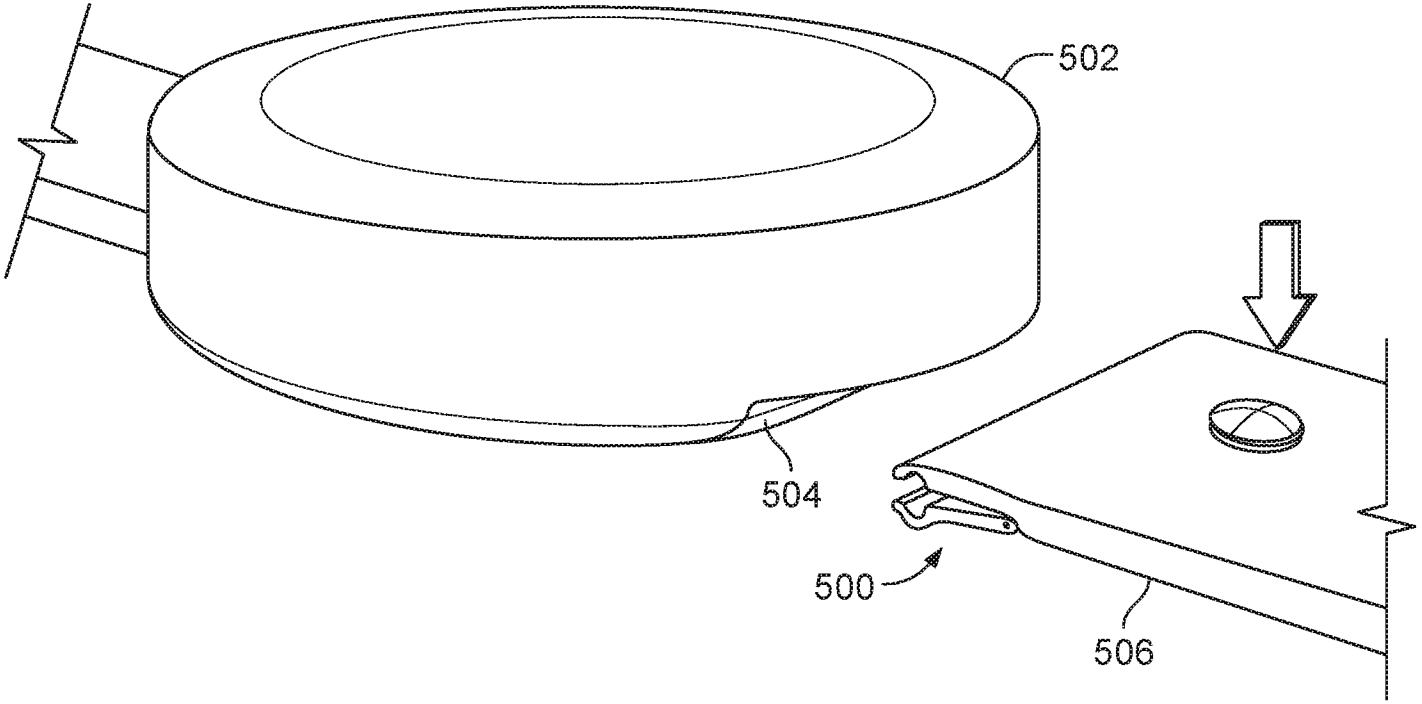
FIGS. 5A and 5E depict views of an example watch band clasp mechanism according to a fourth implementation of the present disclosure.
Figure 5B:
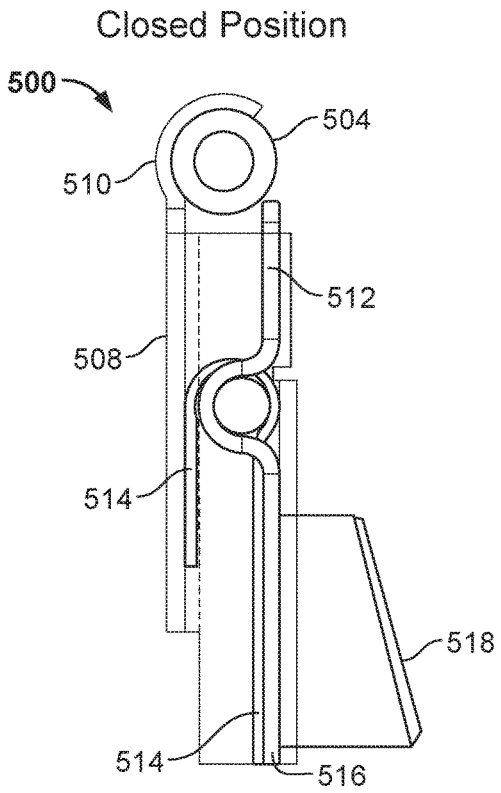
Figure 5C:
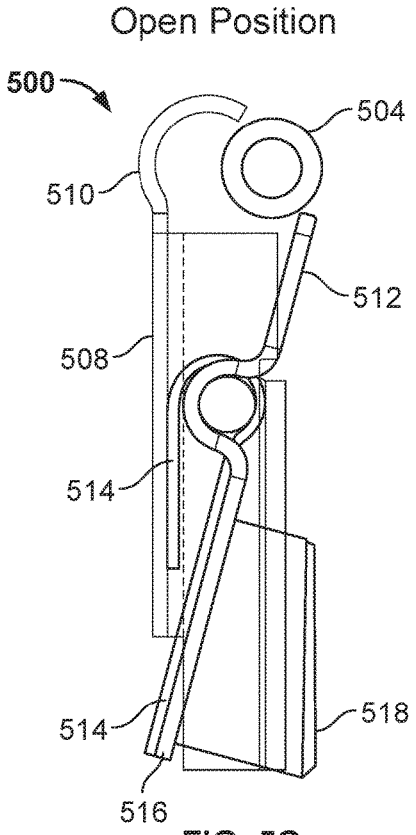
Figure 5D:
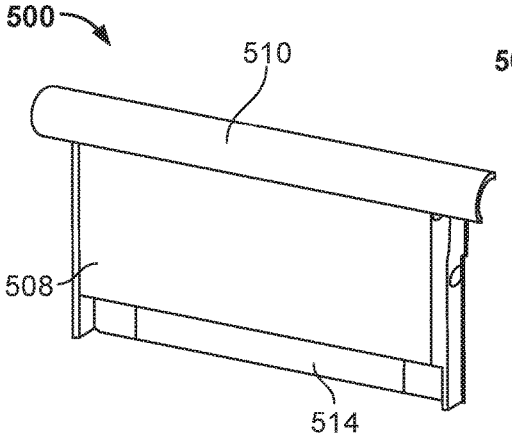
Figure 5E:
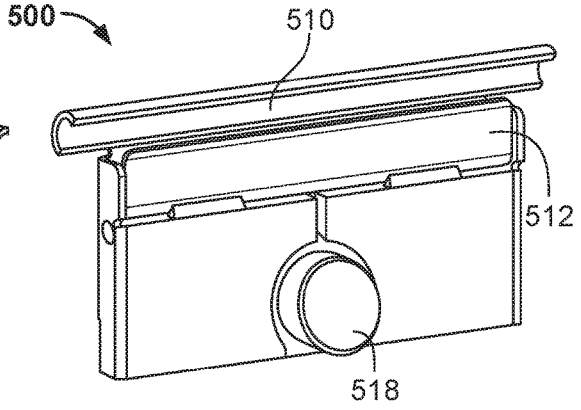

FIG. 5A depicts an example watch band clasp mechanism 500 according to a fourth implementation of the present disclosure. FIGS. 5B and 5C depict internal views of the example watch band clasp mechanism 500 according to the fourth implementation of the present disclosure. FIGS. 5D and 5E depict perspective views of the example watch band clasp mechanism 500 according to the fourth implementation of the present disclosure.

FIGS. 5A-5C illustrate a watch module 502 with a pin bar 504, e.g., a spring pin bar, and a strap 506 with a pivoting clasp mechanism 500. Referring to FIGS. 5B-5E, the pivoting clasp mechanism 500 includes a fixed member 508 with a concave extension 510 at one end configured to accept the pin bar 504 on the watch module 502, and a pilotable rocker 512. A spring 514 such as, for example, a cantilever spring or a leaf spring, is positioned between the fixed member 508 and one end 516 of the rocker 512. When clasped to the watch module, the rocker 512 is held under spring pressure, against the pin bar 504 and serves to retain the pin bar 504 within the curved extension 510. A button 518 is coupled to the rocker 512 to allow a user to pivot the rocker 512 away from the pin bar 504 and the curved extension 510, and thereby, release the pin bar 504 from the clasp mechanism 500.

While a number of examples have been described for illustration purposes, the foregoing description is not intended to limit the scope of the invention, which is defined by the scope of the appended claims. There are and will be other examples and modifications within the scope of the following claims.

The invention claimed is:

1. A watch band comprising:

a strap; and a clasp mechanism connected with the strap at a proximal end of the clasp mechanism, the clasp mechanism comprising:

a member defining a channel at a distal end of the clasp mechanism, a pivot member held in a fixed position with respect to the member defining the channel;

a rocker member configured to rotate about a pivot point defined by the pivot member, the rocker member having a first portion that extends generally away from the pivot member toward the distal end of the clasp mechanism and a second portion that extends generally away from the pivot member toward the proximal end of the clasp mechanism, the rocker member further configured to pivot between:

(i) a first position in which the rocker member covers a portion of the channel sufficient to prevent a spring pin of a watch module from being removed from the channel, and (ii) a second position in which an end of the rocker member is positioned sufficiently far away from the channel to allow a spring pin of a watch module to be removed from the channel; and a button affixed to the rocker member, wherein the button is configured to cause the rocker member to pivot from the first position to the second position when pressed.

2. The watch band of claim 1, wherein the clasp mechanism further comprises a spring configured to bias the rocker member toward the first position and away from the second position.

3. The watch band of claim 2, wherein the clasp mechanism further comprises a fixed member connected to the member defining the channel; and wherein the spring comprises a cantilever spring in contact with a portion of the fixed member and a portion of the rocker member.

4. A watch band comprising:

a strap; and a clasp mechanism connected with the strap at a proximal end of the clasp mechanism, the clasp mechanism comprising:

a member defining a channel at a distal end of the clasp mechanism, a pivot member held in a fixed position with respect to the member defining the channel; and a rocker member configured to rotate about a pivot point defined by the pivot member, the rocker member having a first portion that extends generally away from the pivot member toward the distal end of the clasp mechanism and a second portion that extends generally away from the pivot member toward the proximal end of the clasp mechanism, the rocker member further configured to pivot between:

(i) a first position in which the rocker member covers a portion of the channel sufficient to prevent a spring pin of a watch module from being removed from the channel, and (ii) a second position in which an end of the rocker member is positioned sufficiently far away from the channel to allow a spring pin of a watch module to be removed from the channel;

wherein the clasp mechanism further comprises a spring configured to bias the rocker member toward the first position and away from the second position;

wherein the clasp mechanism further comprises a fixed member connected to the member defining the channel;

wherein the spring comprises a cantilever spring in contact with a portion of the fixed member and a portion of the rocker member; and wherein at least a portion of the spring at least partially encircles the pivot member.

5. The watch band of claim 2, wherein the clasp mechanism further comprises:

a housing member connected to the member defining the channel;

wherein a portion of the button extends through the housing member.

6. The watch band of claim 2, wherein a portion of the button extends through the strap.

7. The watch band of claim 2, wherein the button is configured to cause the rocker member to pivot, when the button is pressed, in a radial direction that is opposite the radial direction in which the spring biases the rocker member.

8. A watch comprising:

a watch module comprising first and second bars; and first and second watch bands, each of the first and second watch bands comprising:

a strap; and a clasp mechanism connected with the strap at a proximal end of the clasp mechanism, the clasp mechanism comprising:

a member defining a channel at a distal end of the clasp mechanism, a pivot member held in a fixed position with respect to the member defining the channel; and a rocker member configured to rotate about a pivot point defined by the pivot member, the rocker member having a first portion that extends generally away from the pivot member toward the distal end of the clasp mechanism and a second portion that extends generally away from the pivot member toward the proximal end of the clasp mechanism, the rocker member further configured to pivot between:

(i) a first position in which the rocker member covers a portion of the channel sufficient to prevent the first or second bar of the watch module from being removed from the channel, and (ii) a second position in which an end of the rocker member is positioned sufficiently far away from the channel to allow the first or second bar of the watch module to be removed from the channel; and a button affixed to the rocker member, wherein the button is configured to cause the rocker member to pivot from the first position to the second position when pressed.

9. The watch of claim 8, wherein the clasp mechanism further comprises a spring configured to bias the rocker member toward the first position and away from the second position.

10. The watch of claim 9, wherein the clasp mechanism further comprises a fixed member connected to the member defining the channel; and wherein the spring comprises a cantilever spring in contact with a portion of the fixed member and a portion of the rocker member.

11. The watch of claim 10, wherein at least a portion of the spring at least partially encircles the pivot member.

12. The watch of claim 9, wherein the clasp mechanism further comprises:

a housing member connected to the member defining the channel;

wherein a portion of the button extends through the housing member.

13. The watch of claim 9, wherein a portion of the button extends through the strap.

14. The watch of claim 9, wherein the button is configured to cause the rocker member to pivot, when the button is pressed, in a radial direction that is opposite the radial direction in which the spring biases the rocker member.

* * * * *